United States Patent [19]

Moore et al.

[11] Patent Number: 4,687,057

[45] Date of Patent: Aug. 18, 1987

[54] DETERMINING STEAM DISTRIBUTION

[75] Inventors: John S. Moore, Ponca City, Okla.; Farhad Ghassemi, Lafayette, La.

[73] Assignee: Conoco, Inc., Ponca City, Okla.

[21] Appl. No.: 765,995

[22] Filed: Aug. 14, 1985

[51] Int. Cl.[4] ..... E21B 43/24

[52] U.S. Cl. ..... 166/252; 166/272

[58] Field of Search ..... 166/250, 252, 268, 269

[56] References Cited

U.S. PATENT DOCUMENTS

| | | | |
|---|---|---|---|
| 2,352,834 | 7/1944 | Hassler . | |
| 2,390,770 | 12/1945 | Barton et al. . | |
| 3,199,587 | 8/1965 | Santourian . | |
| 3,434,541 | 3/1969 | Cook et al. . | |
| 3,507,620 | 4/1970 | Gurney . | |
| 3,565,173 | 2/1971 | Anderson . | |
| 3,682,244 | 8/1972 | Bowman et al. | 166/252 |
| 3,905,422 | 9/1975 | Woodward . | |
| 3,999,606 | 12/1976 | Bandyopadhyay et al. . | |
| 4,129,182 | 12/1978 | Dabbous . | |
| 4,182,416 | 1/1980 | Trantham et al. . | |
| 4,231,426 | 11/1980 | Carter et al. . | |
| 4,265,310 | 5/1981 | Britton et al. . | |
| 4,399,359 | 8/1983 | Fertl et al. . | |
| 4,508,169 | 4/1985 | Mut et al. | 166/250 |

OTHER PUBLICATIONS

SPE/DOE Paper No. 12683, Ferrell et al., "Analysis of Low-Tension Pilot at Big Muddy Field, Wy", p. 4.

*Primary Examiner*—Stephen J. Novosad
*Assistant Examiner*—Thomas J. Odan
*Attorney, Agent, or Firm*—A. Joe Reinert

[57] ABSTRACT

An enhanced oil recovery method utilizes a monitored salinity concentration decline in produced water at the various producing wells of a steam flood project to determine actual steam distribution. This actual steam distribution is utilized to determine appropriate production capability modifications for certain ones of the producing wells so as to cause the actual steam distribution to more closely approximate a predetermined preferred steam distribution so as to maximize oil production from the steam flood project.

14 Claims, 6 Drawing Figures

DETERMINING STEAM DISTRIBUTION

BACKGROUND OF THE INVENTION

1. Field of the Invention

The present invention relates generally to steam flooding enhanced oil recovery techniques. Techniques are provided for determining the actual distribution of steam throughout an area of a subsurface oil bearing formation to a plurality of producing wells, as a basis for making subsequent modifications in the production capability of the producing wells to thereby modify the distribution of the injected steam.

2. Description of the Prior Art

It is well known that most oil bearing formations will product only a relatively small portion of the total oil in place through conventional production techniques. As a result a number of processes have been developed which are referred to as enhanced oil recovery techniques, for producing some of the oil which is left behind after primary and secondary production techniques.

One such technique is steam flooding. Steam is injected into a formation to heat and mobilize the oil in the formation and drive that oil toward producing wells. Such techniques are particularly useful in fields where the oil deposits are relatively heavy and viscous.

SUMMARY OF THE INVENTION

The present invention provides a steam flooding enhanced oil recovery method which involves a novel technique for determining the distribution of steam within an area of the formation which is being steam flooded.

A pattern of wells is provided which includes at least one injection well intersecting an underground oil-bearing formation for injecting steam into an area of the formation surrounding the injection well. The pattern also includes a plurality of producing wells intersecting the area of the formation for producing oil and other fluids from a plurality of sectors of the area. Each of the sectors is associated with one of the producing wells and defines a portion of the area to be drained by its associated producing well.

During the steam injection phase of the steam flood operation, a salinity concentration of produced water is monitored from each of the producing wells to thus identify producing wells where salinity concentration is declining as a result of an inflow of fresh water which is condensed from injected steam. Also, a cumulative volume of produced water is monitored for each of the producing wells.

From the salinity concentration decline and cumulative volume data collected during the steam injection phase of the steam flood project, an instantaneous relative steam portion can be determined for each of the producing wells.

The instantaneous relative steam portion is that portion of a total flow rate of steam being injected into the area of the formation which is flowing to each of the producing wells at any given time.

Also, a pore volume of each sector which has been contacted by injected steam can be determined.

Analysis of the instantaneous relative steam portions for the various producing wells provides an indication of the distribution of steam within the various sectors of the area of the formation into which steam is being injected.

That measured steam distribution can then be compared to a predetermined preferred steam distribution, and appropriate modifications can be made to the production capabilities of one or more of the producing wells to modify the actual steam distribution so that it will more closely approximate the predetermined preferred steam distribution.

Also a comparison of the relative contacted pore volumes for each sector in the instantaneous relative steam portions for each sector can provide information as to the existence of channels between the injection well and one or more of the producing wells.

An object of the invention is to provide improved steam flooding enhanced oil recovery methods including improved techniques of determining actual steam distribution within an undergoing oil-bearing formation.

Numerous other objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

General Background

In a typical enhanced oil recovery project utilizing injected steam to heat and move viscous oil deposits to producing wells, a pattern of wells is generally utilized having a plurality of producing wells surrounding one or more injection wells.

Figure 1:
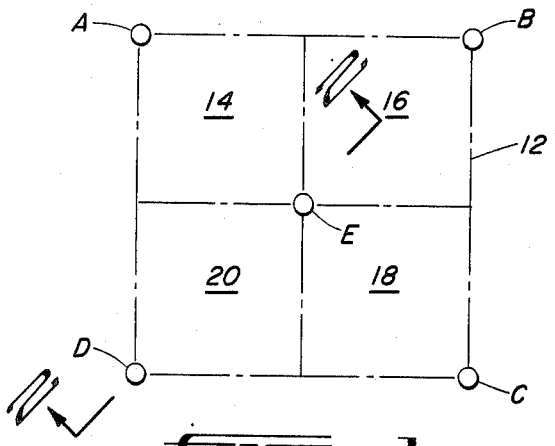
FIG. 1 is a schematic plan view of an inverted five-spot pattern including one injection well and four producing wells for a steam flood project.

FIG. 1 illustrates what is commonly referred to as an inverted five spot pattern having four producing wells A, B, C and D which are located at the four corners of a square, with a single injection well E located in the center of the square.

Figure 2:
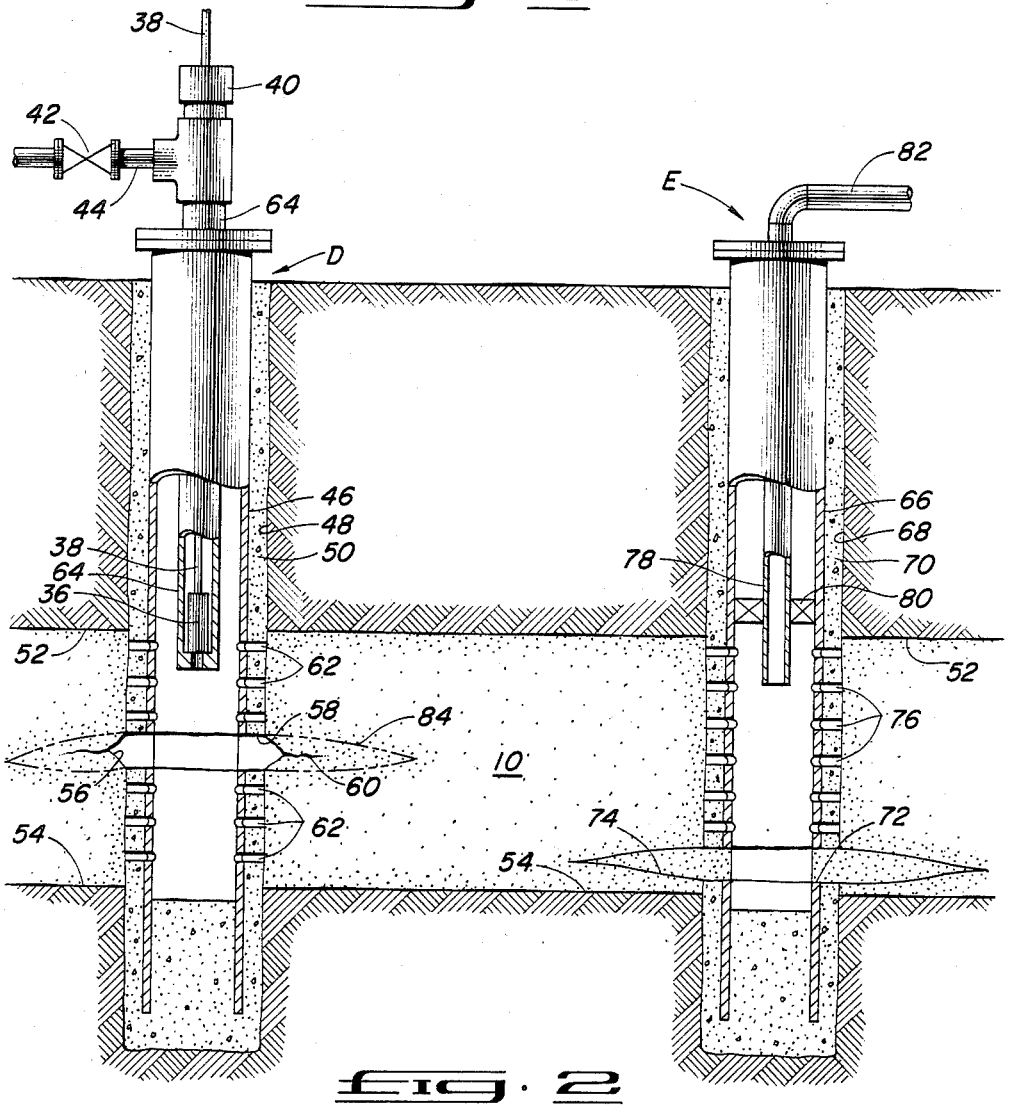
FIG. 2 is a somewhat schematic sectioned elevation view taken along line 2—2 of FIG. 1, showing the injection well and one of the producing wells along with the various associated subsurface strata.

FIG. 2, which is a somewhat schematic elevation section view taken along line 2—2 of FIG. 1 shows the producing well D on the left and the injection well E on the right.

Each of the wells A, B, C, D and E intersects an underground oil bearing formation 10. The purpose of the injection well E is to inject steam or in some instances other fluids into the formation 10 and to cause oil contained within formation 10 to move toward and be produced from the producing wells such as D.

In FIG. 1, an imaginary area of formation 10 in a square shape defined at its corners by the four producing wells A, B, C and D is shown in phantom lines and designated by the numeral 12. Further, phantom lines divide the area 12 into a plurality of sectors 14, 16, 18 and 20 associated with the producing wells A, B, C and D, respectively. Each of the sectors 14, 16, 18 and 20 is associated with one of the producing wells and defines a portion of the area 12 of formation 10 to be drained by its associated producing well.

As will be understood by those skilled in the art, steam flow from injection well E is not totally confined to area 12. Generally, however, the flow of steam is confined within area 12 by a combination of natural barriers which may exist and/or injection of back-up water into surrounding wells to prevent any significant flow of steam outside of area 12.

In any steam flood project, one of the primary investments is the energy cost for producing the steam and it is of course desirable that this injected steam be utilized in the most efficient manner possible so as to maximize the production of oil from the steam flood operation.

The activities involved in maximizing the efficiency of a steam flood operation can generally be thought of in three steps. First, a decision must be made as to what the preferred distribution of steam is within a given steam flood pattern so as to maximize oil recovery if that preferred steam flood distribution is achieved. Second, some means must be provided for measuring or determining the actual distribution of steam within the steam flood pattern at various stages within the steam flood operation. Third, there must be a means for modifying the distribution of steam within the steam flood pattern to make it more closely approximate the predetermined preferred distribution if it is determined that the actual steam distribution significantly differs from the preferred steam distribution.

The present application is primarily concerned with the second step, namely that of determining the actual steam distribution within a steam flood pattern. The data developed in determining actual steam distribution within a steam flood pattern may, however, then be used as a basis for making decisions with regard to the third step of modifying steam distribution.

DETERMINING THE PREFERRED STEAM DISTRIBUTION

Those portions of the methods of the present invention which relate solely to determining the actual steam distribution achieved in a steam flood project can be utilized in conjunction with any predetermined preferred steam distribution. The actual steam distribution determined through the use of the methods of the present invention can be compared to that preferred steam distribution in order to make decisions as to necessary modifications to the production capabilities of the various producing wells so as to modify the actual steam distribution to make it more closely approximate the preferred steam distribution.

Some examples of different bases upon which a preferred steam distribution might be determined would include preferring an even distribution of steam so that equal amounts of steam go to the various sectors of the area of the steam flood project, and would also include a preferred steam distribution based on reservoir pore volume distribution.

It has been determined, however, that the most efficient use of steam in a steam flood process is accomplished if the steam is distributed throughout the various sectors 14, 16, 18 and 20 of area 12 of formation 10 in the same proportions as oil is present within those sectors. This is preferable to an uncontrolled distribution, to an even distribution within the sectors when oil is not evenly distributed, and to a steam distribution based upon reservoir pore volume distribution.

The preference for distributing steam based on the volume of oil in place as opposed to the reservoir pore volume can be illustrated with a simple thought experiment. Consider two blocks of rock of equal pore volume connected to a common steam injection well. For the first case, let both blocks or rock have the same oil saturation so that they contain equal volumes of oil (hydrocarbon pore volumes). In this case, it would be desirable for both blocks to receive equal quantities of steam. This satisfies the distribution based on reservoir pore volume as well as one based on hydrocarbon pore volume. In the second case, let one block contain recoverable hydrocarbons and the other be devoid of any oil. In this case, it would be desirable to direct all of the steam to the block containing the hydrocarbons. This satisfies a desired steam distribution based only on hydrocarbon pore volume. A distribution based on reservoir pore volume would in the second case allow steam to move into the block where no oil exists and would be a waste of the investment in the steam. Consequently, when variations in oil saturation might exist, as is often the case in a previously water flooded formation, the desired steam distribution should be based on the distribution of hydrocarbon within the steam flood pattern.

This, the first step in determining the desired relative proportions of steam distribution within the sectors 14, 16, 18 and 20, is to determine the estimated volume of oil in place within each sector, which can be accomplished by conventional reservoir analyses and engineering calculations. This is then converted to a desired steam distribution as shown by the following example.

EXAMPLE NO. 1

Consider an inverted five spot pattern as illustrated in FIG. 1 with available information obtained from reservoir analyses and engineering calculations showing the respective estimated volumes of oil in place within the sectors 14, 16, 18 and 20 as shown on the following Table I.

TABLE I

| Sector | Estimated Volume of Oil In Place (bbls) |
|---|---|
| 14 | 10,000 |
| 16 | 30,000 |
| 18 | 40,000 |
| 20 | 35,000 |

The desired steam distribution is then determined by dividing the estimated sector oil in place by the total estimated volume of oil in place within the entire area 12 which gives an estimated relative oil portion of a total area oil volume which is in place in each sector.

That relative oil portion defines a desired steam distribution for each sector as a percentage of total injected steam as shown in the following Table II.

TABLE II

| Sector | Desired Steam Distribution |
|---|---|
| 14 | 9% |
| 16 | 26% |
| 18 | 35% |
| 20 | 30% |

DETERMINING INSTANTANEOUS STEAM DISTRIBUTION

First, it should be noted that there are two basic types of steam flood processes. These are referred to as "displacement" type steam flood operations and "drag" type steam flood operations.

A "displacement" type steam flood operation is the type illustrated in the present disclosure, whereby steam is injected into a large portion of the formation to displace oil and in-situ formation water toward the producing wells.

A "drag" type steam flood operation involves the use of channels, e.g., open fractures, between the injection well and the producing wells. Steam is forced through the channels, and as the vapor expands from the channel into the surrounding formation, it drags oil and in-situ formation water along with the flowing steam toward the producing wells.

Although the methods of the present invention are primarily intended to be used with displacement type steam flood operations, they can also be used with drag type steam flood operations in some cases.

Previously, determinations of actual steam distribution have generally been based upon observing the relative fluid production rates at each of the producing wells. Since the produced fluids are generally assumed to be displaced by injected steam, the fluid production rates do correlate to some extent to steam distribution within the area 12. Typically, steam injection is allowed to proceed without modifying the production capabilities of any of the producing wells until such time as a temperature increase in produced fluids and an increase in produced oil are detectable at the various producing wells. Then a decision may be made based upon relative production rates as to whether the production capabilities of any of the producing wells should be modified. In a typical steam flood project, the temperature response and oil response at the producing wells may not be detectable until over halfway through the steam injection phase of the project.

If the actual steam distribution can be determined at an earlier point during the steam injection phase of the project, then rational decisions for modification of the production capabilities of the various producing wells can be made at a much earlier stage and thus be more effective in actually modifying the actual steam distribution to make it more closely approximate whatever predetermined preferred steam distribution has been decided upon.

By the methods of the present invention, a salinity concentration of produced water from each of the producing wells is monitored to identify producing wells where salinity concentration is declining as a result of inflow of fresh water which is condensed from injected steam.

This technique is useful for any formation which has a relatively high in-situ brine salinity concentration. Condensation of injected steam results in dilution of the in-situ brine. Consequently, the salinity concentration of the produced water declines from the initial in-situ value once injected fresh water arrives at a particular production well. This salinity concentration decline can be detected at the producing wells A, B, C and D and monitored to see how it changes as a function of time.

It has been determined that the salinity concentration decline will be the first key response observed at the producing wells. A significant salinity concentration decline is generally detectable long before a temperature response or oil response is detectable at the producing wells.

In a typical steam flood project wherein the steam injection phase lasts, for example, for a period of six months, a detectable salinity concentration decrease may occur one month into the steam injection phase whereas a detectable temperature response and oil response may not occur until three or four months into the steam injection phase of the project.

Of course if a particular producing well is communicated with the injection well by an open fracture, the various responses may be detectable at a much earlier time, but still the salinity concentration decline will generally be detectable a few weeks prior to the time a temperature response can be detected.

From the salinity concentration decline data, an instantaneous relative steam portion, of a total flow rate of steam being injected into the area 12, which is flowing to each of the producing wells A, B, C and D can be determined by determining a flow rate of fresh water required to cause the salinity concentration decline which has been measured.

The salinity concentration decline can be converted mathematically to a fraction of fresh water which, when multiplied by the total water production rate of the particular producing well, will yield a fresh water or steam condensate production rate. The ratio of the fresh water production rate at one of the producing wells to the total of the fresh water production rates for all four of the producing wells is the instantaneous relative steam portion for that particular producing well. Such a calculation is shown in the following example.

EXAMPLE NO. 2

Calculating Instantaneous Relative Steam Portions

For example, if the initial chloride concentration (salinity concentration) of the in-situ brine of the formation 10 is determined to be 80,000 ppm (parts per million), and if subsequent to initiating the steam flood operation, producing well B corresponding to sector 16 is observed to be producing 1,000 B/D (barrels per day) of water with a chloride concentration of 72,000 ppm, corresponding to a ten percent decrease in salinity concentration, it follows that ten percent, i.e., 100 B/D, of the produced water is condensed steam.

By making similar calculations for each of the producing wells and then determining the instantaneous relative steam portion for each well by merely determining its relative percentage of fresh water production, the actual steam distribution within the area 12 is determined.

The instantaneous relative steam portion for each producing well is approximately equal to the percentage of injected steam which at that time is flowing from the injection well E into the sector associated with that particular producing well.

By then comparing these instantaneous relative steam portions to the predetermined preferred relative steam portions, which may be determined as shown above in Table II, for the sectors associated with each of the producing wells, it can be determined which sectors of the area 12 are receiving more steam than preferred and which sectors of the area 12 are receiving less steam than preferred.

Then a production capability of at least one of the producing wells A, B, C or D may be modified thus changing an instantaneous relative steam portion which is flowing to said at least one producing well and to at least one other of said producing wells to more closely approximate the preferred relative steam portions for the sectors associated with said one producing well and with said other producing well.

This increases the total volume of oil recovered from steam flooding of the area 12 as compared to the total volume of oil which would have been recovered in the absence of modifying the production capabilities of one of the wells, because the injected steam is distributed to the various zones 14, 16, 18 and 20 of the area 12 in proportions more closely approximating the predetermined preferred portions that would have been the case in the absence of modifying the production capabilities.

Furthermore, the modification of the production capabilities based upon monitoring of salinity concentration declines at the producing wells can be made at a much earlier point within the steam injection phase of the project than could be done if the modification were made based upon some other criteria such as temperature response or oil response at the producing wells.

By making the production capability modification at an earlier stage, that modification can be much more effective in actually changing the steam distribution within the area 12 and thus can be more effective in maximizing the amount of oil produced from the area 12 during the steam flood project.

DETERMINING FRESH WATER CONTACTED PORE VOLUMES

Data other than the instantaneous relative steam distribution within the area 12 can be determined from monitoring the salinity concentration decline along with monitoring a cumulative volume of produced water for each of the producing wells. This data is useful in a number of ways.

First, it is helpful to explain the theory behind the fresh water contacted pore volume calculations.

Figure 3:
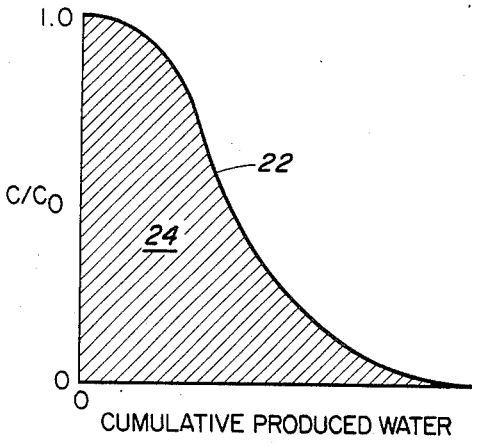
FIG. 3 is a representative normalized plot of produced water salinity concentration as a function of cumulative produced water for one of the producing wells, in a situation where there is no outside water contributing to water production.

FIG. 3 is a general representation of a plot representing salinity concentration on a normalized basis versus the cumulative produced water for a well which is not producing any water from sources outside its associated sector 4, 16, 18 or 20. Since the cumulative produced water is a function of time, the plot shown in FIG. 3 can also be generally considered as a plot of salinity concentration versus time.

Assuming that the particular sector involved has a uniform initial chloride concentration, steam injection begins at time zero which corresponds to zero cumulative produced water on the horizontal axis of FIG. 3.

In FIG. 3 the horizontal axis represents cumulative produced water (both in-situ brine and condensed steam) beginning at time zero corresponding to the time at which steam injection begins. The vertical axis represents the normalized chloride concentration represented by $C/C_o$ where C is the instantaneous chloride concentration and $C_o$ is the initial salinity concentration at time zero.

The curve 22 represents the declining chloride concentration at one of the producing wells as a function of cumulative produced water. The assumption has been made in FIG. 3 that the background chloride concentration, $C_o$, remains constant which generally is a reasonable assumption. If it is in fact known that $C_o$ varies with time, that variable can be accounted for.

The shaded area 24 under the curve 22 represents the volume of in-situ formation water which has been displaced from the sector associated with the particular producing well during the steam injection project. This volume of displaced in-situ formation water is proportional to the pore volume which has been contacted by injected steam in the sector under consideration, i.e., the fresh water contacted pore volume associated with the particular producing well.

That area or volume can, of course, be obtained by numerically integrating the curve 22. This shaded area 24 can generally be described as a plot area. That plot area can, of course, be determined without actually drawing a plot like that shown in FIG. 3. The data representing curve 22 could, for example, be recorded and the integrating performed by a computer or some other means.

As previously mentioned, FIG. 3 is representative of a producing well where there is no produced water flowing in from outside the area 12. Thus, the normalized chloride concentration ultimately drops to zero when all of the in-situ brine formation water has been produced from the particular sector associated with a particular producing well. All of the produced water is condensed steam from that time forward.

Figure 4:
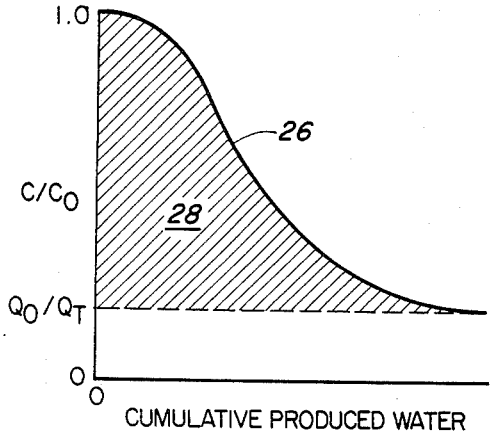
FIG. 4 is a representative normalized plot of produced water salinity concentration as a function of cumulative produced water for one of the producing wells in a situation where outside water is contributing to the water production.

FIG. 4 is a representative plot of normalized salinity concentration as a function of cumulative produced water for a producing well where there is an inflow of outside water to the producing well. This outside water will generally come from water injection wells surrounding area 12, and in some instances also from natural water sources.

In this area, the curve 26 reaches an asymptote at a volume $Q_o/Q_T$ where $Q_o$ is a production rate of water from outside the area 12 of formation 10 and $Q_T$ is a production rate of total produced water from the particular producing well under consideration.

The value $Q_o$ for production of outside water can be readily determined by conventional reservoir engineering techniques, and the value $Q_T$ is of course measured at the producing well, so that value $Q_o/Q_T$ can be readily ascertained for any given producing well.

For the curve 26 of FIG. 4, the total volume of displaced in-situ formation water produced from the well during the steam injection projection is the shaded area 28 below the curve 26 and above the value $Q_o/Q_T$ on the vertical axis of the plot.

The representative plots shown in FIGS. 3 and 4 represent the entire time period of the stream injection project, and as is further discussed below, the total volumes of displaced in-situ formation water provide significant and valuable information.

Figure 5:
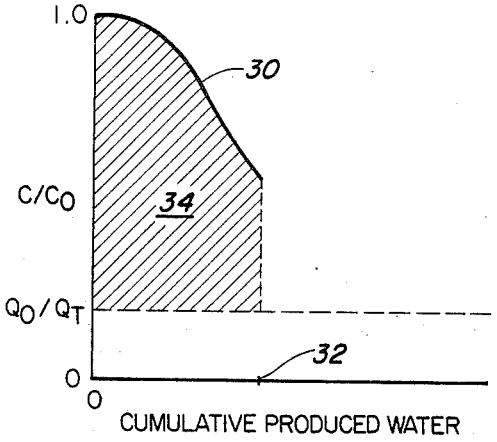
FIG. 5 is a representative normalized plot of produced water salinity concentration as a function of cumulative produced water at an early stage in the steam flood project.

FIG. 5 is a representative plot similar to that in FIG. 4, but it represents the normalized salinity concentration as a function of cumulative produced water at a relatively early stage during the steam injection phase of a project.

In FIG. 5, the curve 30 represents the salinity concentration of a producing well as a function of cumulative produced water for a period of time beginning at time zero corresponding to the beginning of steam injection and continuing through an intermediate time represented by the point 32 on the horizontal axis of the plot, which intermediate time is between the beginning time and an ending time of the steam injection phase of the project.

Preferably, the intermediate time represented at 32 is a time much earlier than any time at which either a temperature response or an oil response could be detected at the producing well under consideration.

Again by using conventional integration techniques, the shaded area 34 under the curve 30 can be determined. The are 34 corresponds to the cumulative volume of displaced in-situ formation water for the particular producing well over the period of time beginning at time zero and continuing through the intermediate time corresponding to the point 32.

This cumulative displaced in-situ formation water data determined as just described with regard to FIG. 5, is useful in a number of ways.

The cumulative displaced in-situ formation water production data at these intermediate times can be utilized along with the instantaneous steam distribution as shown in Table II above to locate steam channels between the injection well E and various ones of the production wells A, B, C and D at an early stage in the steam injection project.

Additionally, the total displaced in-situ formation water data as represented in FIGS. 3 and 4 can be utilized at the completion of the steam injection project to determine the actual fresh water contacted pore volumes for the entire area 12 which were affected by the steam injection, which data is very useful in evaluating the overall effectiveness of the steam flood project and in making decisions as to the operation of future steam flood projects. This technique is also further described below.

From a plot of decreasing salinity concentration as a function of cumulative produced water, such as just described with regard to FIG. 5, the cumulative displaced in-situ formation water production up to the intermediate time such as represented at point 32 can be determined, as just described, by determining the shaded area 34.

As mentioned, that volume of cumulative displaced in-situ formation water is proportional to the pore volume of the formation 10 which was contacted by injected steam and contributed to the production at the particular producing well.

This contacted pore volume associated with each of the producing wells can be determined by taking the cumulative displaced in-situ formation water volume such as represented by the area 34 and dividing that volume by the initial average water saturation for the particular sector 14, 16, 18 or 20 associated with the producing well under consideration.

The initial average water saturation is a conventional term which represents the percentage of rock pore volume which is initially filled with in-situ formation water prior to beginning steam flooding.

The value of the initial average water saturation is determined from historical data on the area 12 through standard engineering practices. Also, if some infill drilling is done specifically for the steam flood project, well logs can be analyzed to provide additional bases for determining the initial average water saturation.

For example, if the cumulative displaced in-situ formation water represented by the shaded area 34 for a given well is 1,000 barrels, and if the initial average water saturation for the sector associated with that producing well is seventy percent, then the contacted rock pore volume for that sector is equal to $1000/0.7 = 1{,}429$ barrels.

DETECTION OF STEAM CHANNELS THROUGH USE OF FRESH WATER CONTACTED PORE VOLUMES

One use for the cumulative displaced in-situ formation water data such as that represented by the shaded area 34 in FIG. 5 at some intermediate time during the steam flood project, is to detect the existence of open fractures or steam channels between the injection well E and one or more of the producing wells A, B, C or D.

This is done by monitoring the salinity concentration decline of produced water and the cumulative volume of produced water for some period of time beginning at the beginning of the steam injection phase and extending through some intermediate time short of the end of the steam injection phase, as was previously described with regard to FIG. 5.

Figure 6:
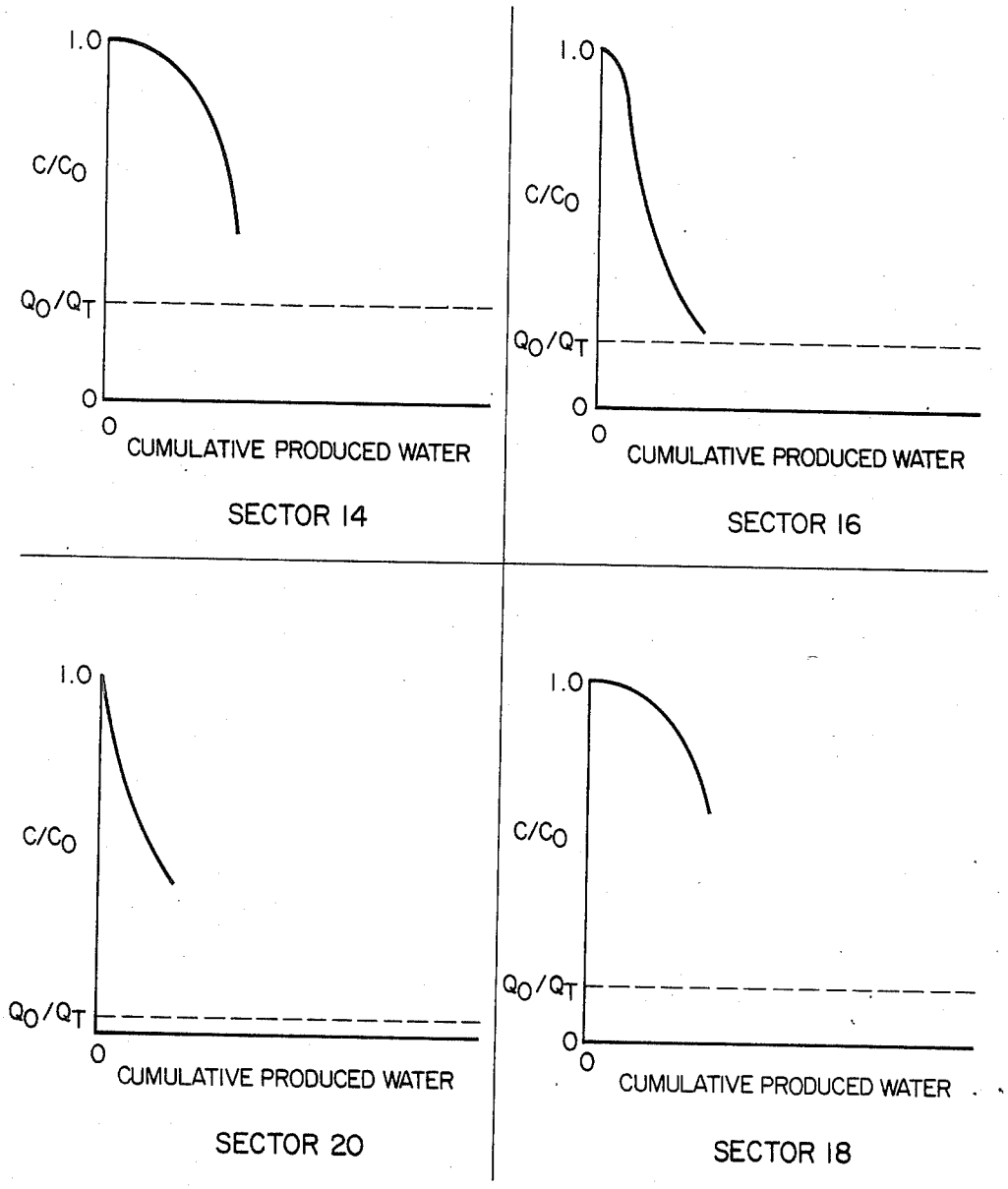
FIG. 6 shows a representative example of an unmatured salinity concentration plot such as that of FIG. 5, for each of the sectors 14, 16, 18 and 20 of the inverted five-spot pattern illustrated in FIG. 1.

FIG. 6, for example, shows plots of salinity concentration decline as a function of cumulative produced water for each of the wells A, B, C and D corresponding to the sectors 14, 16, 18 and 20 in a manner like that previously described with regard to FIG. 5.

By determining the area under each of the curves for each of the four sectors represented in FIG. 6, in a manner similar to the determination of the shaded area 34 in FIG. 5 previously described, and then calculating a fresh water contacted pore volume corresponding to those areas for each of the four sectors, it can be determined on a relative basis which of the four wells A, B, C and D have the greatest or smallest contacted pore volumes.

By comparing these relative contacted pore volumes to the instantaneous relative steam portions determined as previously described in Example No. 2, certain poorly performing producing wells can be located. A poorly performing producing well, which is communicated with the injection well E by a steam channel, can be detected by locating those producing wells which have both a relatively low fresh water contacted pore volume and a relatively high instantaneous steam portion.

For example, consider the inverted five-spot pattern as illustrated in FIG. 1, having performed as represented in FIG. 6. As is apparent from a qualitative comparison of the four graphs shown in FIG. 6, assuming that the initial average water saturation for the four sectors are the same in this example, producing wells A and C corresponding to sectors 14 and 16 have relatively large contacted pore volume, whereas producing wells B and D corresponding to sectors 16 and 20 each have a relatively low contacted pore volume.

Also assume that the instantaneous relative steam portions for the four wells at the intermediate time corresponding to the rightmost ends of the curves shown in FIG. 6 is determined to be as shown in the following Table III based upon determining the instantaneous fresh water flow rates necessary to cause the salinity decrease measured as of that intermediate time.

TABLE III

| Sector | Well | Instantaneous Relative Steam Portion |
|---|---|---|
| 14 | A | 15% |
| 16 | B | 45% |
| 18 | C | 30% |
| 20 | D | 10% |

For the situation represented by FIG. 6 and Table III, it is apparent that producing well B corresponding to sector 16 has both a relatively low contacted pore volume as seen in the upper right quadrant of FIG. 6, and a relatively high instantaneous steam portion as seen in Table III.

This indicates that although a relatively high portion of the steam being injected into the area 12 is flowing into sector 16 and to producing well B, that high volume of steam is flowing through a very low pore volume as indicated by the relative areas under the curves shown in FIG. 6, thus indicating that the steam is channeling through an open fracture or the like which communicates injection well E with producing well B.

When such a poorly performing well is identified, steps should be taken to restrict fluid production from the poorly performing producing well and thus direct steam away from the poorly performing producing well to the other ones of the producing wells.

Preferably, the poorly performing well would not be immediately shut in, but rather would have its production choked back to attempt to reduce the instantaneous relative steam portion flowing thereto to a value close to the desired steam distribution for that well as represented for example in Table II.

If choking back of the well does not result in an increase in fresh water production at the other wells, such as might be the case if the steam is merely bypassing the poorly producing well and flowing outside of the area 12, then the poorly producing well is completely shut in and efforts should be made to provide a barrier to flow out of the sector associated with that producing well, such as by injecting water in other wells surrounding that portion of the area 12.

DETERMINING TOTAL FRESH WATER CONTACTED PORE VOLUMES FOR THE AREA 12 FOR THE COMPLETED STEAM FLOOD PROJECT

As previously mentioned, fully matured plots of salinity versus cumulative produced water similar to those shown in FIGS. 3 and 4 can be utilized after the steam flood project is completed to actually determine the total fresh water contacted pore volume for the entire area 12. This is accomplished in the following manner.

First, the cumulative displaced in-situ formation water for each of the four wells is determined by determining the area under the curve such as represented for example by the shaded area 28 in FIG. 4 for each well.

That cumulative displaced in-situ formation water for each well can then be converted to a fresh water contacted pore volume for the sector associated with that well by dividing the displaced in-situ formation water volume by the initial average water saturation for that sector.

Then the total contacted reservoir pore volume for the entire area 12 is obtained by adding up the fresh water contacted pore volumes for the four sectors 14, 16, 18 and 20.

It will often be observed that the fresh water contacted pore volumes either for given ones of the sectors, or for the entire area 12 as a whole, will exceed the rock pore volume which actually exists within the arbitrary phantom line boundaries defining the sectors 14, 16, 18 and 20 in FIG. 1.

This is entirely possible since the boundaries represented by the phantom lines in FIG. 1, which are used for the sector pore volume estimates, are entirely arbitrarily assigned.

In a real-life situation, the injected steam will expand and will affect areas outside the phantom line boundary of area 12 to some extent.

The fresh water contacted pore volumes calculated in the manner just described represent the volumes being swept by both injected steam and fresh water condensed from injected steam.

PRODUCTION RATE MODIFICATION TECHNIQUES

For the various methods just described, it has been mentioned several times that the production capabilities of one or more of the producing wells A, B, C or D is to be modified to cause the actual steam distribution to more closely approximate the predetermined preferred steam distribution.

These production rate modification techniques will now be more specifically described with regard to FIG. 2.

When a well such as well D, for example, is determined to be receiving significantly less than its desired portion of the total injected steam, one or more of the other wells A, B or C will obviously be receiving more than its desired portion of the total injected steam. Thus, to correct an undesirable steam distribution pattern, a production capability of at least one of the producing wells A, B, C or D must be modified. One or more of those producing wells A, B, C or D which is receiving less than its desired portion of the total injected steam will be pumped down and/or stimulated to increase its production and/or one or more of the wells which are receiving more than their desired portion of the total injected steam will have their fluid production restricted. Such modifying actions will cause the steam distribution within the pattern to change to more closely approximate the desired steam distribution.

It will be appreciated upon reviewing the more detailed explanation of the preferred stimulation and restriction techniques discussed below, that these techniques do not provide precise control of the steam distribution. It often will not be possible to so modify the steam distribution as to have it exactly approximate the previously determined desired steam distribution. Nevertheless, the techniques described below will generally cause the steam distribution to more closely approximate the predetermined desired steam distribution and will thereby increase the overall efficiency of steam flooding of the area 12 to increase the total volume of oil recovered from all of the producing wells A, B, C and D as compared to the total volume of oil which would be recovered in the absence of modifying the production capabilities of at least one of the producing wells.

For producing wells located in sectors that are receiving more than the desired portion of injected steam, production modification is relatively easy. In the first instance, fluid production from a well such as well D seen in FIG. 2 is restricted by increasing the production fluid level within the well. This is accomplished by reducing the pumping rate of downhole pump 36 which is operated by a conventional string of sucker rods 38 extending through a stuffing box 40. If the back pressure exerted upon the formation 10 by a full column of fluid within producing well D does not reduce the steam flow to producing well D to the desired level, then production is choked by partially closing a valve 42 in wellhead production line 44. If necessary, the valve 42 can be completely closed to shut in the well D and completely stop production therefrom.

If the portion of injected steam flowing toward well D is lower than the preferred proportion thereof, the first approach to increasing flow toward well D is to pump down the level of fluid within well D as low as possible to create a pressure sink within the formation 10 adjacent the well D. Quite often, however, simply pumping down the fluid level in the non-responding well is not sufficient to draw the desired portion of steam toward that well.

A particularly useful technique has been developed for stimulating a non-responding producing well to increase the proportional flow of injection steam toward that well. This technique involves the initial notching of the well, subsequently performing a small unpropped frac job at the notch, and then perforating the well over the entire depth of formation 10. Later, if necessary, a propped frac job can be performed to stimulate production from the well. This technique can be better understood after the well structure illustrated in FIG. 2 is further described.

The producing well D is defined by a casing 46 which is cemented within a borehole 48 by cement material 50.

The well D intersects the subsurface oil bearing formation 10 which is defined by upper and lower boundaries 52 and 54.

Prior to beginning the steam flood operation, an annular notch 56 is created which extends through casing 46 and the cement material 50 into the formation 10. Notch 56 preferably is located at approximately a middle elevation of the formation 10. The notch 56 can be created in two ways.

The first method of creating notch 56, which is illustrated in FIG. 2, comprises cutting a window 58 through the casing 46 and cement material 50.

The window 58 is preferably approximately three inches in height, and its necessary height is determined by the potential thermal expansion of casing 46. The window 58 should be sufficiently wide that it cannot be closed by subsequent thermal expansion of the casing 46.

The window can be cut with a rotatable hydraulic jetting tool which is lowered into the well on a string of tubing. Such a tool preferably is rotated at an angular velocity of approximately five revolutions per minute while pumping gelled brine containing 1.0 pounds per gallon of 20–40 mesh sand at a rate of approximately five barrels per minute. This process is repeated three additional times, raising the tubing $\frac{3}{4}$ inch between cuts. Thus, four $\frac{3}{4}$-inch cuts create a three-inch wide window.

A second manner of creating the notch 56 is by high density perforation techniques. Preferably, an interval of 12 to 18 inches of casing 46 is perforated with a very high perforation density. Although this does not actually sever the casing 46, it will cause a subsequent frac job to occur at the location of the high density perforations, and it will aid in obtaining a horizontal fracture orientation. The term "notch" is used in this application to refer generally to any technique, such as the two just described, which will serve to initiate a horizontal fracture extending radially from a predetermined location on the casing.

Once the notch 56 is created in the well D, by either of the two described techniques, a small unpropped fracture 60 is initiated by pumping from 20 to 200 barrels of fracturing fluid (brine) through the notch 56 into the formation 10. Preferably, about 100 barrels of fracturing fluid are used.

Then, fracturing fluid pressure is released allowing the relatively small unpropped fracture 60 to close as shown in FIG. 2.

Finally, after creating notch 56 and the unpropped fracture 60, the entire depth of formation 10 is perforated as indicated by perforations 62 to facilitate draining of the entire formation 10.

The purpose of this notching and initiation of the small unpropped fracture 60 is to predetermine the location of a possible subsequent propped fracture which may be necessary to stimulate the well.

By the technique of notching and fracturing before perforating, the location of any subsequent propped fracture is predetermined, and also the fracture is at least initiated as a substantially horizontal fracture which is the preferred type of fracture for stimulation of the well.

By allowing the fracture to close back up as shown in FIG. 2, the initial flow of injected steam to well D from injection well E will not be affected.

Then the producing well D is completed with production tubing 64 which receives pump 36 previously mentioned.

Injection well E is similarly constructed from a casing 66, borehole 68 and cement 70.

The well E is notched at 72 near the lower boundary 54 of formation 10, and is hydraulically fractured and propped to create a large propped fracture 74. Then the well E is perforated as indicated at 76 throughout the entire depth of formation 10.

Steam injection tubing 78 is then located within the well and sealed off above formation 10 by packer 80. A steam supply line 82 provides steam to the well E from a conventional source of steam supply.

Preferably, steam is injected into information 10 at a pressure less than the frac pressure of injection well E, so that the fracture 74 will not open further and allow disruption of the proppant material contained therein.

In a steam injection pattern like that illustrated in FIG. 1, each of the producing wells A, B, C and D that has not previously been fractured is preferably prepared by notching and creating an initial unpropped fracture as shown on well D in FIG. 2. It will be appreciated, however, that if certain ones of the producing wells A, B, C and D have previously been fractured during primary or secondary recovery techniques, it will not be possible to control a subsequent fracturing job in the manner described with regard to well D. This is because those wells which have previously been fractured would refracture at the location of their initial fractures if an attempt was later made to fracture them again.

Thus, the technique described with reference to well D is generally concerned only with wells that have been newly drilled for purposes of the steam flood project, or which in any event have not previously been fractured.

After the steam injection project has begun, and the initial steam distribution is determined in the manner described previously, well D can be stimulated if it is not receiving its desired portion of injected steam by hydraulically fracturing well D to extend the relatively small unpropped fracture 60 to create a larger fracture 84 extending further into the formation as indicated in phantom lines in FIG. 2, and by concurrently propping the fracture 84 with a proppant material to create a larger propped fracture.

This will then stimulate production from the well D and generally will draw more of the injected steam toward well D so that more of the oil in place in sector 20 associated with well D will be heated and caused to be produced.

By combining the various techniques discussed above to modify the production capabilities of one or more of the producing wells and thereby cause the distribution of injected steam within the area 12 to more closely approximate the preferred steam distribution within the various sectors 14, 16, 18 and 20, the total oil produced during the steam injection project will be increased as compared to what it would otherwise be in the absence of the production modification techniques of increasing production from non-responding wells, and decreasing or shutting down production from overly actively responding wells as the case may be.

Thus it is seen that the methods of the present invention readily achieve the ends and advantages mentioned as well as those inherent therein. While certain preferred embodiments of the invention have been illustrated and described above in detail for the purposes of the present disclosure, numerous changes in the arrangement and make-up of the various steps may be made by those skilled in the art, which changes are encompassed within the scope and spirit of the present invention as defined by the appended claims.

What is claimed is:

1. An enhanced oil recovery method comprising steps of:

(a) providing a pattern of wells, including at least one injection well intersecting an underground oil bearing formation for injecting steam into an area of said formation surrounding said injection well, and including a plurality of producing wells intersecting said area of said formation for producing oil and other fluids from a plurality of sectors of said area, each of said sectors being associated with one of said producing wells and defining a portion of said area to be drained by its associated producing well;

(b) injecting steam into said formation through said injection well;

(c) monitoring a salinity concentration of produced water from each of said producing wells to thus identify producing wells where salinity concentration is declining as a result of an inflow of fresh water which is condensed from injected steam;

(d) determining an instantaneous relative steam portion, of a total flow rate of steam being injected into said area, which is flowing to each of said producing wells by determining a flow rate of fresh water required to cause a salinity concentration decline measured in step (c) for each of said producing wells;

(e) comparing said instantaneous relative steam portion determined in step (d) to a predetermined preferred relative steam portion for the sector associated with each of said producing wells to determine which sectors of said area are receiving more steam than preferred and which sectors of said area are receiving less steam than preferred;

(f) then modifying a production capability of at least one of said producing wells and thus changing an instantaneous relative steam portion, of the total flow rate of steam being injected into said area, which is flowing to said at least one producing well and to at least one other of said producing wells to more closely approximate the preferred relative steam portions for the sector associated with said one producing well and said other producing well; and (g) thereby increasing a total volume of oil recovered as compared to the total volume of oil which would have been recovered in the absence of step (f).

2. The method of claim 1, wherein:

said step (d) is performed at a time before any increase in temperature of fluid produced from any of said producing wells as a result of heating of said fluid by injected steam is detectable.

3. The method of claim 2, wherein:

said step (f) is performed at a time before any increase in temperature of fluid produced from any of said producing wells as a result of heating of said fluid by injected steam is detectable, so that a distribution of injected steam within said area is adjusted at an earlier time than it could possibly have been adjusted in response to a monitored increase in produced fluid temperature.

4. The method of claim 1, wherein:

said step (d) is performed at a time before any increase in oil production from any of said producing wells as a result of injecting steam into said formation is detectable.

5. The method of claim 4, wherein:

said step (f) is performed at a time before any increase in oil production from any of said producing wells as a result of injecting steam into said formation is detectable, so that a distribution of injected steam within said area is adjusted at an earlier time when it could possibly have been adjusted in response to a monitored increase in oil production.

6. The method of claim 1, wherein:

said step (d) is performed at a time when neither an increase in produced fluid temperature nor an increase in oil production from any of said producing wells as a result of injecting steam into said formation is yet detectable.

7. The method of claim 6, wherein:

said step (f) is performed at a time when neither an increase in produced fluid temperature nor an increase in oil production from any of said producing wells as a result of injecting steam into said formation is yet detectable, so that a distribution of injected steam within said area is adjusted at an earlier time than it could possibly have been adjusted in response to a monitored increase in either said produced fluid temperature or said oil production.

8. An enhanced oil recovery method comprising the steps of:

(a) providing a pattern of wells, including at least one injection well intersecting an underground oil bearing formation for injecting steam into an area of said formation surrounding said injection well, and including a plurality of producing wells intersecting said area of said formation for producing oil and other fluids from a plurality of sectors of said area, each of said sectors being associated with one of said producing wells and defining a portion of said area to be drained by its associated producing well;

(b) injecting steam into said formation through said injection well;

(c) monitoring both a salinity concentration decline of produced water and a cumulative volume of produced water for each of said producing wells for a period of time beginning with a beginning time of said step (b) and continuing through an intermediate time between the beginning time and an ending time of said step (b);

(d) determining from said salinity concentration decline of produced water and said cumulative volume of produced water, a fresh water contacted pore volume corresponding to each of said producing wells over said period of time;

(e) determining, at approximately said intermediate time, an instantaneous relative steam portion, of a total flow rate of steam being injected into said area of said formation, which is flowing to each of said producing wells by determining a flow rate of fresh water required to cause a decreased salinity as measured at approximately said intermediate time for each of said producing wells;

(f) comparing said fresh water contacted pore volumes to said instantaneous relative steam portions of each of said producing wells to locate a poorly performing producing well connected to said injection well by a steam channel by determining that said poorly performing producing well has both a relatively low fresh water contacted pore volume and a relatively high instantaneous steam portion as compared to the other ones of said producing wells;

(g) modifying a production capability of said poorly performing producing well by restricting fluid production from said poorly performing producing well, thus directing steam away from said poorly performing producing well and to the other ones of said producing wells; and (h) thereby increasing a total volume of oil recovered as compared to the total volume of oil which would have been recovered in the absence of said step (g).

9. The method of claim 8, wherein:

said step (d) includes a step of determining a plot area under a plot of salinity concentration of produced water expressed as a fraction of original salinity of in-situ formation water, versus cumulative produced water during said period of time, for each of said producing wells.

10. The method of claim 9, wherein:

said step (d) is further characterized in that said plot area under said plot is above a vlue $Q_o/Q_T$ on a vertical axis of said plot, where $Q_o$ is a production rate of water from outside said area of said formation and $Q_T$ is a production rate of total produced water.

11. An enhanced oil recovery method comprising steps of:

(a) providing a pattern of wells, including at least one injection well intersecting an underground oil bearing formation for injecting steam into an area of said formation surrounding said injection well, and including a plurality of producing wells intersecting said area of said formation for producing oil and other fluids from a plurality of sectors of said area, each of said sectors being associated with one of said producing wells and defining a portion of said area to be drained by its associated producing well;

(b) injecting steam into said formation through said injection well;

(c) monitoring both a salinity concentration decline of produced water and a cumulative volume of produced water for each of said producing wells throughout substantially an entire duration of said step (b);

(d) based at least partially upon an observed steam distribution within said area of said formation as determined from said salinity concentration decline, modifying a production capability of at least one of said producing wells and thus changing an instantaneous relative steam portion, of a total flow rate of steam being injected into said area, which is flowing to said at least one producing well and to at least one other of said producing wells, to more closely approximate a predetermined preferred relative steam portion for the sectors associated with said one producing well and said other producing well;

(e) thereby increasing a total volume of oil recovered as compared to the total volume of oil which would have been recovered in the absence of step (d);

(f) subsequent to completion of said step (b), determining from said salinity concentration decline of produced water and said cumulative volume of produced water, a volume of displaced in-situ formation water produced by each of said producing wells; and (g) determining from said volume of displaced in-situ formation water a fresh water contacted pore volume for each of said producing wells to determine a total contacted reservoir pore volume.

12. The method of claim 11, wherein:

said step (f) is accomplished by determining a plot area under a plot of salinity concentration of produced water expressed as a fraction of original salinity concentration of in-situ formation water, versus cumulative produced water, for each of said producing wells.

13. The method of claim 12, wherein:

said step (f) is further characterized in that said plot area under said plot is above a value $Q_o/Q_t$ on a vertical axis of said plot, where $Q_o$ is a production rate of water from outside said area of said formation and $Q_T$ is a production rate of total produced water.

14. The method of claim 11, wherein:

said step (g) is further characterized in that said volume of displaced in-situ formation water is divided by an initial average water saturation for the sector associated with each of said producing wells to determine a contacted sector pore volume associated with each producing well, the total of said contracted sector pore volumes equaling said total contacted reservoir pore volume.

* * * * *